US006116978A

United States Patent [19]

Clemens

[11] Patent Number: 6,116,978

[45] Date of Patent: Sep. 12, 2000

[54] METHOD FOR MANUFACTURING QUILTS

[76] Inventor: Mary Heidi Clemens, P.O. Box 291, Oceanside, Oreg. 97134

[21] Appl. No.: 09/298,591

[22] Filed: Apr. 23, 1999

[51] Int. Cl.[7] ..... A63H 33/04

[52] U.S. Cl. ..... 446/85; 112/262.1

[58] Field of Search ..... 446/85; 112/262.1

[56] References Cited

U.S. PATENT DOCUMENTS

| | | | |
|---|---|---|---|
| 2,202,592 | 5/1940 | Maxson | 446/85 |
| 5,272,995 | 12/1993 | Harger | 112/262.1 |
| 5,354,224 | 10/1994 | Ishiyama | 446/85 X |

*Primary Examiner*—Sam Rimell

[57] ABSTRACT

The present invention relates to a method for constructing quilts. A series of blocks are utilized with each block including six faces. Each face of each block is includes a predetermined pattern. The blocks are arranged such that the upper surfaces of the blocks define a quilt pattern which is used as the basis for the overall design of the quilt. Individual quilt components may constructed and then connected together in accordance with the quilt pattern defined by the upper surfaces of the blocks. As an alternative approach, the quilt pattern defined on the upper surface of the blocks may traced onto a sheet of paper, with the tracing subsequently used to define the quilt pattern.

2 Claims, 3 Drawing Sheets

METHOD FOR MANUFACTURING QUILTS

FIELD OF THE INVENTION

The present invention relates generally to methods of making quilts, and more particularly, to a method of establishing a quilt pattern for using in constructing a quilt.

BACKGROUND OF THE INVENTION

Currently, pre-developed quilt patterns may be obtained from publications relating to the hobby of quilting. However, these sources are limited and do not support innovation in quilt design.

There are also computer programs available which enable quilters to develop patterns. However, these programs require a knowledge of the usage of computers and a certain degree of computer literacy, in addition to access to a computer itself. Not all quilters will have access to computers or have the necessary degree of computer literacy needed to operate programs of this type.

Some quilters create designs with the aid of graph paper, and construct grid lines used to layout quilt designs. However, the process of experimenting with and re-drawing the grid lines whenever a design change is desired can be both laborious and time consuming.

Also available on the market are plain blocks of various sizes and shapes imprinted with letters of the alphabet or solid colors. Typically, these blocks are used as play items for children or may be used for educational purposes for children. However, such blocks have never been used for the purpose of manufacturing quilts or designing quilt constructions.

SUMMARY OF THE INVENTION

Accordingly, a need exists for a simplified method for producing designs of quilts. In addition, a need exists for a method of designing quilts which permits changes to the quilt design without the use of expensive or computerized equipment. Furthermore, a need exists for a method producing quilts in which the quilt pattern can be rapidly configured and changed without labor intensive or time consuming method steps.

In accordance with the parameters recited above, the present invention sets forth a method for manufacturing quilts which incorporates a set of three dimensional blocks, with each block having six faces with a predetermined pattern displayed on each face. The method comprises the steps of arranging a plurality of blocks into a unified set where the predetermined patterns displayed on the upper surfaces of the blocks define a quilt pattern. A plurality of quilt components are then prepared, where each of the quilt components have one of the predetermined patterns from those displayed on the upper surfaces of the blocks. The quilt components are then connected together so as to produce the quilt pattern displayed on the upper surfaces of the blocks.

In accordance with the parameters recited above, the present invention further sets forth a method for manufacturing quilts which incorporates a set of three dimensional blocks, with each block having six faces with a predetermined pattern displayed on each face. The method comprises the steps of arranging a plurality of blocks into a unified set where the predetermined pattern displayed on the upper surface of the blocks define a quilt pattern. The quilt pattern is then traced onto a sheet of paper. A plurality of quilt components are then prepared, where each of the quilt components have one of the predetermined patterns from those displayed on the supper surfaces of the blocks. The quilt components are then connected together so as to produce the quilt pattern displayed on the upper surfaces of the blocks.

DETAILED DESCRIPTION OF THE PREFERRED EMBODIMENTS

Figure 1:
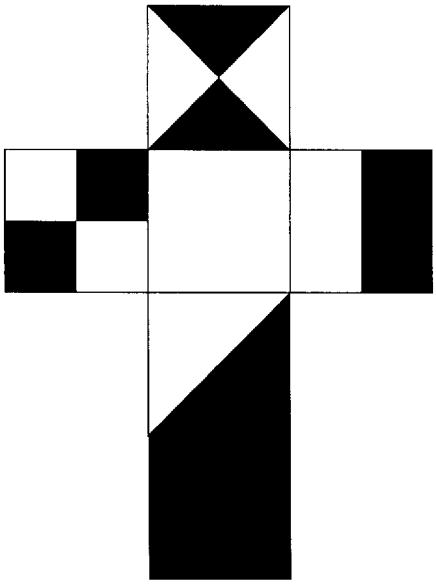
FIG. 1 is a planar view of all six faces of a quilting block used in accordance with the preferred embodiments of the invention.
Figure 2:
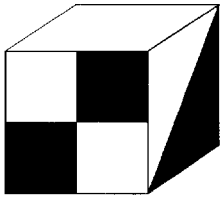
FIG. 2 is an isometric view of the quilting block illustrated in FIG. 1.
Figure 3:
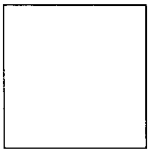
FIG. 3 is a side view of the block of FIG. 2.
Figure 4:
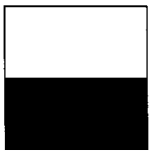
FIG. 4 is another side view of the block of FIG. 2.
Figure 5:
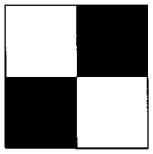
FIG. 5 is another side view of the block of FIG. 2.
Figure 6:
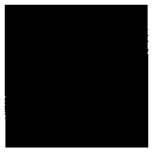
FIG. 6 is another side view of the block of FIG. 2.
Figure 7:
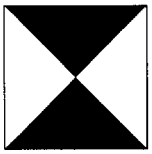
FIG. 7 is another side view of the block of FIG. 2.
Figure 8:
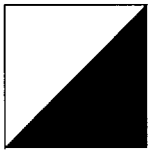
FIG. 8 is another side view of the block of FIG. 2.
Figure 9:
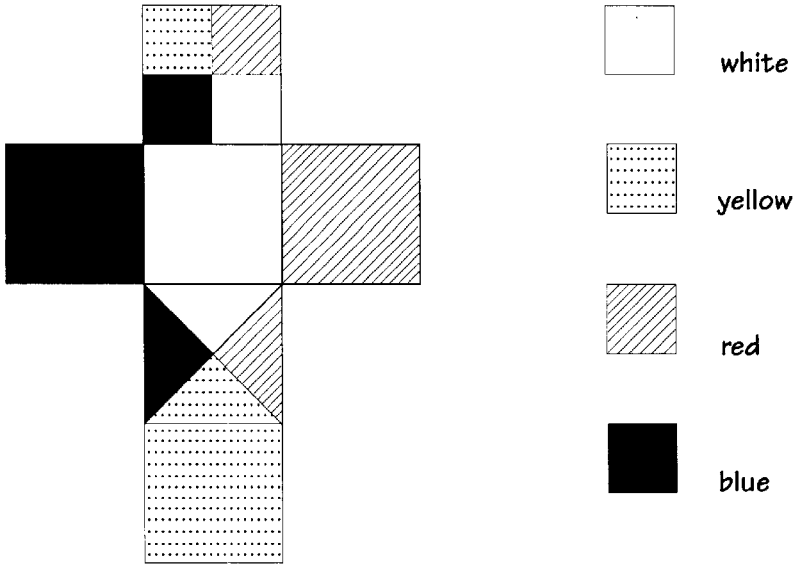
FIG. 9 is a planar view of all six faces of another quilting block used in accordance with the preferred embodiments of the invention, including illustrations of the colors in the block.

FIGS. 1 and 2 are views of a quilting block utilized according to the preferred embodiments of the present invention. FIG. 1 presents a planar view of all of the sides of the block, while FIG. 2 presents an isometric view of the block. Each of the blocks used in the preferred embodiment of the present invention are cubic and include a predetermined pattern on the face of each cube. The predetermined pattern may be plain, or may include a series of colored rectangles, triangles, and combinations thereof. The predetermined pattern can be the same on each face of the cube, or each may include a different predetermined pattern. The predetermined patterns may be formed in a single color or may be formed in combinations of colors. The invention is not construed to be limited to particular colors or particular predetermined patterns. Examples of different patterns which may be imprinted on the blocks are illustrated in FIGS. 1–9.

Figure 10:
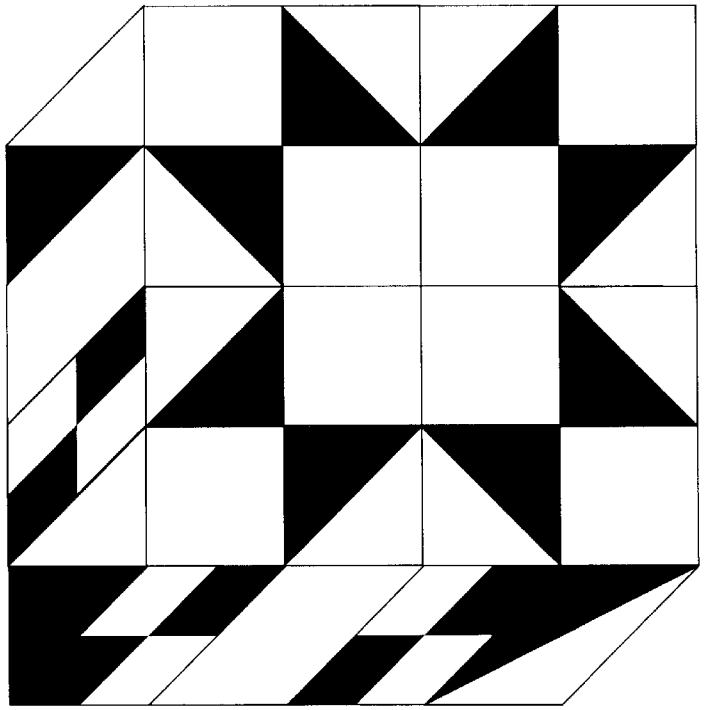
FIG. 10 is an isometric view of the quilting blocks combined to form a quilting pattern.

FIG. 10 illustrates an arrangement where the blocks are combined into a unified set. The design formed by the blocks of the unified set thus establish the overall quilt pattern.

Figure 11:
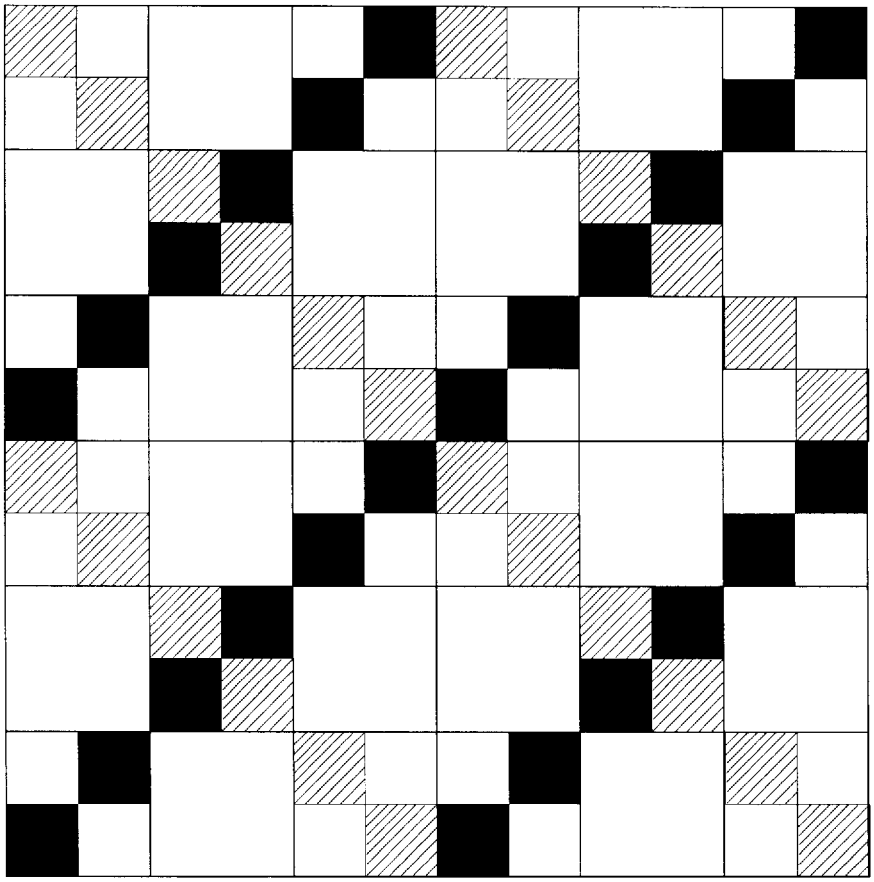
FIG. 11 is a top view of a series of arranged quilting blocks according to the preferred embodiments of the invention.
Figure 12:
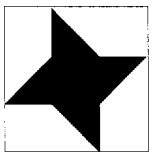
FIGS. 12–19 are side views of quilting blocks in accordance with alternative embodiments of the invention.
Figure 13:
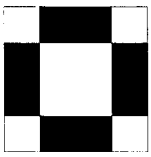
Figure 14:
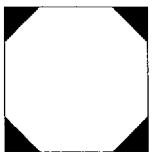
Figure 15:
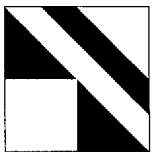
Figure 16:
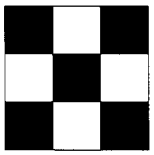
Figure 17:
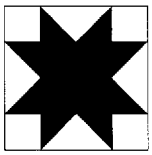
Figure 18:
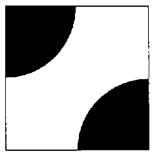
Figure 19:
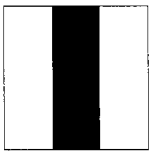

FIG. 11 illustrates an alternative arrangement where the blocks are formed in to a unified set. FIGS. 12–19 illustrate alternative predetermined patterns which may be imprinted on the blocks.

With the blocks arranged in the unified set, as shown in FIG. 10 or 11, the quilter can then copy the quilt pattern illustrated by the blocks. This can be accomplished in one of two ways: The quilter can produce individual quilt components which emulate the pattern shown on the upper surface of each block and then join together each of the individual quilt components. Alternatively, the quilt pattern illustrated by a unified set of blocks can be copied on to paper, such as by tracing, and the copied pattern is used to establish the overall quilt pattern.

The use of the blocks dramatically simplifies the method by which quilts are designed. The blocks are simple to manipulate and each block can include more than one predetermined pattern on its faces. As a result, the blocks can be arranged and re-arranged with no difficulty, and the quilt design thus arranged and re-arranged with very little effort.

The use of blocks eliminates the need for complex drafting or design skills, or the need for a specialized computer program to produce the quilt design. The blocks can be readily manufactured using simple, inexpensive materials, such as wood, plastic and the like.

What is claimed is:

1. A method for manufacturing a quilt which incorporates a set of three dimensional blocks, each block having six faces with a predetermined pattern displayed on each face, comprising the steps of:

arranging a plurality of said blocks into a unified set, wherein said predetermined patterns displayed on said upper surfaces of said blocks define a quilt pattern;

preparing a plurality of quilt components, each of said quilt components having one of said predetermined patterns displayed on said upper surfaces of said blocks;

connecting together said quilt components so as to reproduce said quilt pattern.

2. A method for manufacturing a quilt which incorporates a set of three dimensional blocks, each block having six faces with a predetermined pattern displayed on each face, comprising the steps of:

arranging a plurality of said blocks into a unified set, wherein said predetermined patterns displayed on upper surfaces of said blocks define a quilt pattern;

tracing said quilt pattern onto a sheet a paper;

preparing a plurality of quilt components, each of said quilt components having one of said predetermined patterns displayed on said upper surfaces of said blocks;

connecting together said quilt components according to said traced quilt pattern.

* * * * *